United States Patent [19]

Hauer et al.

[11] Patent Number: 4,494,891

[45] Date of Patent: Jan. 22, 1985

[54] GRATING FOR A HIGHWAY CONSTRUCTION IN PARTICULAR FOR A SEWER OPENING

[75] Inventors: Jean-Claude Hauer, Saulxures lès Nancy; Jacques Oger, Pont-a-Mousson, both of France

[73] Assignee: Pont-A-Mousson S.A., France

[21] Appl. No.: 378,304

[22] Filed: May 14, 1982

[30] Foreign Application Priority Data

Jun. 5, 1981 [FR] France ..... 81 11188

[51] Int. Cl.[3] ..... E03F 5/06

[52] U.S. Cl. ..... 404/4; 210/163; 52/660

[58] Field of Search ..... 404/4, 5, 2, 3, 35, 404/36; 15/238, 239, 240, 241; 210/163, 164, 165, 166; 52/20, 660, 664, 667, 669

[56] References Cited

U.S. PATENT DOCUMENTS

| | | | |
|---|---|---|---|
| 387,189 | 7/1888 | Toffler | 15/238 |
| 397,402 | 2/1889 | Toffler | 15/238 |
| 463,702 | 11/1891 | Mills | 52/669 |
| 817,837 | 4/1906 | Dahlstrom | 15/238 |
| 880,862 | 3/1908 | Chase | 15/238 |
| 1,561,120 | 11/1925 | Smith | 210/164 |
| 2,335,556 | 11/1943 | Wilson | 404/36 |
| 3,527,148 | 9/1970 | Schack | 404/25 |
| 3,945,746 | 3/1976 | Bredbenner | 404/4 |

FOREIGN PATENT DOCUMENTS

| | | | |
|---|---|---|---|
| 152014 | 6/1953 | Australia | 52/664 |
| 918 | of 1892 | United Kingdom | 15/238 |
| 1275277 | 5/1972 | United Kingdom | 210/165 |

*Primary Examiner*—James A. Leppink
*Assistant Examiner*—Beverly E. Hjorth
*Attorney, Agent, or Firm*—Sughrue, Mion, Zinn, Macpeak and Seas

[57] ABSTRACT

A grating (1) is composed of a series of transversal elements (2) which each have a central hole (11) and, at each end and on each surface, a planar surface (5) for abutting an adjacent transversal element. These elements are clamped one against the other by a central crosspiece (3) traversing their central holes. During the passage of rolling loads, the surfaces (5) slide one on the other to ensure at least four effective seat points for the grating, preventing its rocking.

7 Claims, 3 Drawing Figures

GRATING FOR A HIGHWAY CONSTRUCTION IN PARTICULAR FOR A SEWER OPENING

The present invention relates to a grating for a highway construction, in particular for a sewer opening, of the type comprising a series of transversal elements connected by at least one longitudinal clamping crosspiece. Gratings of this type enable standardized manufacture whatever the necessary length desired.

These gratings are intended to rest on theoretically flat or planar frames, for example on two parallel angle irons sealed at the upper end of a drain opening. However, in practice, this flatness or planarity is never guaranteed and the overall unevenness increases with the longitudinal dimensions of the grating, which may then rock with the passage of rolling loads, producing unpleasant noise for surrounding residents.

The object of the invention is to provide a grating which is capable, even when very long, of efficient adaptation to the profile of the support frame.

For this purpose, the object of the invention is a grating of the above-identified type, which comprises a single central crosspiece, its transversal elements having reciprocal abutting surfaces capable of sliding vertically relative to one another.

Preferably the abutting surfaces are located at both ends and on both side faces of each of the transversal elements and, in order to limit the relative sliding of said abutting surfaces, each transversal element contains a stud projecting from each of its two abutting surfaces on one side face and a larger cavity in each of its two other abutting surfaces on the opposite side face.

The adaptability of the grating can be further increased if the crosspiece traverses an oblong hole in the vertical direction of each vertical element.

In accordance with another embodiment which may be suitable for certain uses, the object of the invention is also a grating for highway constructions of the above-identified type, which comprises two crosspieces each traversing a series of aligned holes in the transversal elements, said holes being oblong in the vertical direction, the transversal elements having reciprocal support surfaces able to slide vertically one on the other.

The invention is described hereunder in more detail by means of the attached drawing, which represents only one embodiment thereof. In these drawings.

Figures 1, 2, 3:
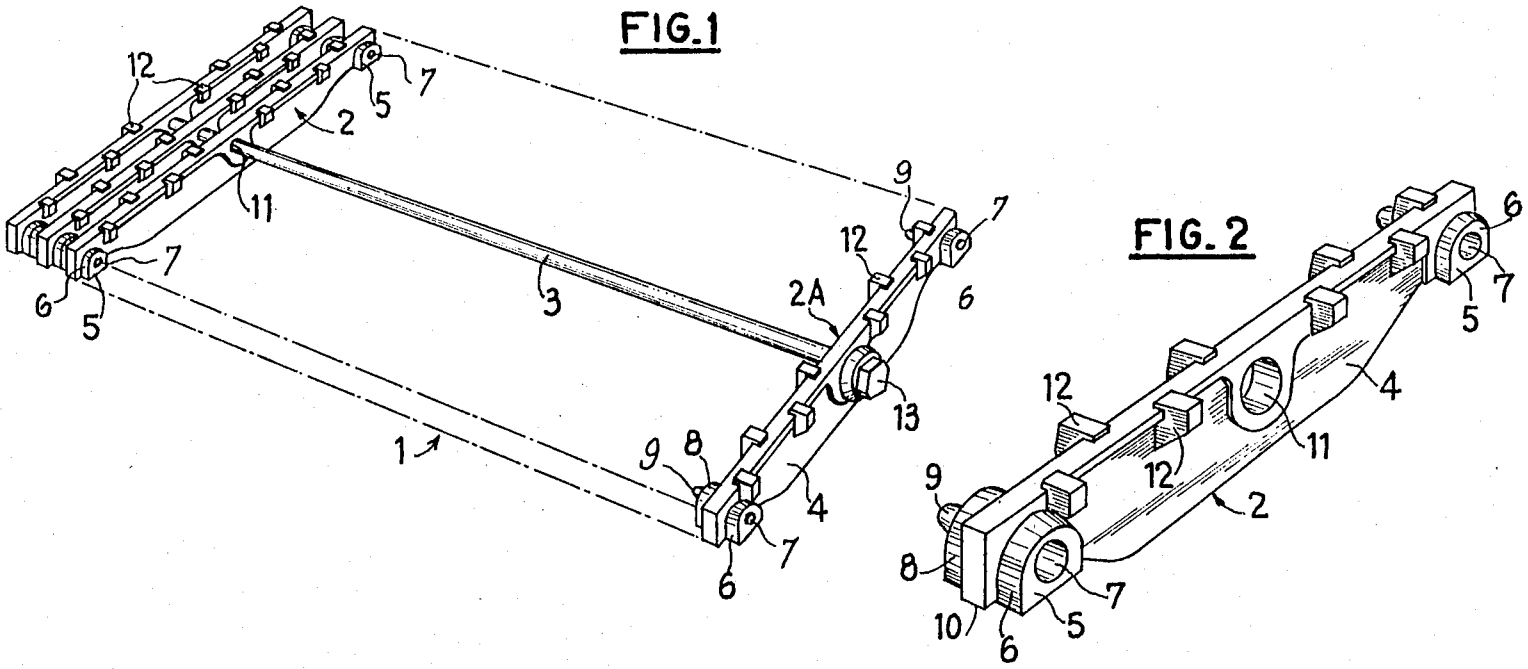
FIG. 1 is a perspective view of a grating in accordance with the invention.
FIG. 2 is a larger scale perspective view of an element of said grating.
FIG. 3 is a planar view of the element of the grating of FIG. 2.

The grating 1 shown in FIG. 1 is composed on the one hand of a certain number of transversal elements 2 and on the other hand of a connecting crosspiece 3.

As can be better seen in FIGS. 2 and 3, each element 2 comprises a vertical wall 4 whose thickness is constant over the majority of its surface but increases at each end, at the center and along the upper edge of said wall.

At each end, wall 4 has on each of its side faces a boss or projecting lug 6 or 8 having, except for a gradual taper or draft angle, the shape of a cylinder whose free end surface 5 is planar and parallel to wall 4.

In surface 5 of the two lugs or bosses 6 located on one side face of the wall is provided a truncated cavity 7, whereas from surface 5 of the other two bosses 8 on the opposite side face projects a truncated stud 9 which is considerably smaller than the cavities 7. Each stud 9 is coaxial with its corresponding cavity 7. On the bottom of each end of each transversal element 2 a lower horizontal support surface 10 is defind by the two lugs 6 and 8 and by the part of wall 4 which separates them.

In the thickened central region of the wall 4 is provided a circular hole 11, and the upper edge of this wall has a series of projections 12 alternately oriented in opposite directions and projecting slightly upwards.

The crosspiece 3 is a tube whose exterior diameter is slightly less than that of hole 11 of elements 2 and whose length corresponds to the desired length of the grating. Each end of this tube is capped with a hex bolt 13.

The grating 1 is preassembled at the factory by threading the necessary number of elements 2 on the crosspiece 3, all of said elements being oriented in the same fashion so that the studs 9 of each element penetrate into the cavities 7 of an adjacent element. If desired, the end element 2A whose cavities 7 face the interior of the grating can be without studs 9.

The two bolts 13 are put into place and tightened completely at the factory, all the elements 2 being aligned and surfaces 5 abutting one against the other, the studs 9 being received approximately coaxially with considerable play in cavities 7. The projections 12 overlap one in the other to provide a discontinuous passage surface on the grating.

In use, the grating 1 is intended to be laid on an upper frame of a shaft or drain opening, wherein the frame is composed of two parallel angle irons on which the planar surfaces 10 of elements 2 are supported. However, in practice, the horizontal wings, turned one towards the other, of these angle irons are never perfectly flat and/or parallel, which causes the grating to tend to rock.

This rocking is stopped in a satisfactory manner with grating 1 since, under the effect of vertical loads, such as rolling loads, to which it is subjected, the abutting surfaces 5 slide one on the other to tend to effectively support surfaces 10 on the angle irons.

If the radial play between the crosspiece 3 and the holes 11 of elements 2 is limited to the necessary play to take into account manufacturing tolerances, it is not certain that all the surfaces 10 will be effectively supported, especially if the horizontal wings of the angle irons are not planar. But at least four surfaces 10, which are normally the four end surfaces 10 located at the four corners of the grating, will always be supported, which is sufficient to eliminate any rocking of the grating. This result is obtained whatever the length of the grill and the number n of elements 2. If j designates the play of the studs 9 in the cavities 7, the corresponding surfaces support 10 of the two end elements 2 can offset themselves vertically one in relation to the other by $n \times j$ approximately.

The perfect adaptability of the grating, that is the guarantee of support for all surfaces 10 on the angle irons in all cases, can be obtained if, as an alternative, the circular holes 11 are replaced by oblong holes elongated in the vertical direction.

In another embodiment, which is not shown, lugs 6 and 8 can be traversed by holes perpendicular to wall 4, crosspiece 3 being replaced by two analogous crosspieces each threaded with vertical play in one of the two series of holes. However, in this case, the height adaptability of end surfaces 10 does not exceed said vertical play, whatever the length of the grating. It is therefore necessary for the holes in elements 2 to be oblong in the vertical direction in order to provide sufficient adaptability for gratings of relatively considerable length.

In all cases, if it is necessary to change the support angle irons of the grating, or if particles become deposited on the angle irons when the grating is removed, the grating readapts itself to its new support conditions by the relative sliding of surfaces 5 one against the other.

We claim:

1. A grating for highway construction, in particular for a sewer opening, of the type comprising a series of transversal elements (2) connected by at least one longitudinal clamping crosspiece (3), said grating comprising only a single central crosspiece (3), the transversal elements (2) having reciprocal abutting surface means, in the form of surfaces (5) capable of sliding vertically relative to each other, for eliminating rocking of the grating when it is supported on a frame and subjected to rolling loads, and wherein each transversal element (2) comprises means (7, 9) for limiting, but still permitting, the relative sliding of said abutting surfaces (5).

2. The grating of claim 1, wherein each transversal element has two side faces, and wherein the abutting surfaces (5) are located at only both ends, and on both side faces, of each transversal element (2).

3. The grating of claim 2 wherein said abutting surfaces are on bosses formed on only said both ends of said each transversal element.

4. The grating of claim 3, the grating being adapted to be supported on a support frame the planarity of whose support surface is imperfect, further comprising a substantially planar bottom support surface on each end of each transversal element, said bottom support surface being defined by the bottom surface of each transversal element and the bottom surfaces of said bosses, whereby rocking of the grating on the surface of the support frame is eliminated by the relative vertical sliding of said abutting surfaces.

5. A grating for highway construction, in particular for a sewer opening, of the type comprising a series of transversal elements (2) connected by at least one longitudinal clamping crosspiece (3), said grating comprising only a single central crosspiece (3), the transversal elements (2) having reciprocal abutting surfaces (5) capable of sliding vertically relative to each other, and wherein each transversal element (2) comprises means (7, 9) for limiting, but still permitting, the relative sliding of said abutting surfaces (5), and wherein the limiting means comprises a stud (9) projecting from the two abutting surfaces (5) on one side face of each transversal element, and a larger cavity (7) in the two other abutting surfaces (5) on the opposite side face of each transversal element (2), the studs and the larger cavities of adjacent transversal elements mating with each other, and the cavities being larger than the studs.

6. The grating of claim 5, wherein each transversal element has two side faces, and wherein the abutting surfaces (5) are located at both ends, and on both side faces, of each transversal element (2).

7. The grating of claim 5 or 6, wherein the studs (9) and the cavities (7) are truncated and congruently tapered.

* * * * *